US010844503B2

(12) United States Patent
Kim et al.

(10) Patent No.: US 10,844,503 B2
(45) Date of Patent: Nov. 24, 2020

(54) PREPARING METHOD OF TIGHTLY SEALED 3D LIPID STRUCTURE AND TIGHTLY SEALED 3D LIPID STRUCTURE PREPARED THEREBY

(71) Applicant: KOREA INSTITUTE OF SCIENCE AND TECHNOLOGY, Seoul (KR)

(72) Inventors: Tae Song Kim, Seoul (KR); Dong-Hyun Kang, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 103 days.

(21) Appl. No.: 16/369,533

(22) Filed: Mar. 29, 2019

(65) Prior Publication Data

US 2020/0087807 A1 Mar. 19, 2020

(30) Foreign Application Priority Data

Sep. 17, 2018 (KR) ..... 10-2018-0110772

(51) Int. Cl.
*C25D 1/00* (2006.01)
*C25D 1/02* (2006.01)

(52) U.S. Cl.
CPC ..... *C25D 1/003* (2013.01); *C25D 1/02* (2013.01)

(58) Field of Classification Search
CPC ..... C25D 1/003
See application file for complete search history.

(56) References Cited

U.S. PATENT DOCUMENTS

2019/0064175 A1* 2/2019 Kim ..... G01N 33/554

FOREIGN PATENT DOCUMENTS

KR 10-1913342 B1 10/2018

OTHER PUBLICATIONS

Dong-Hyun Kang et al., "Sealing effect of 3D lipid structure arrays by frequency change", The 20th Korean MEMS Conference, Apr. 5-7, 2018 Abstract.

* cited by examiner

*Primary Examiner* — Brian W Cohen
(74) *Attorney, Agent, or Firm* — Rabin & Berdo, P.C.

(57) ABSTRACT

A method for preparing a tightly sealed 3D lipid structure and a tightly sealed 3D lipid structure prepared thereby is disclosed. The method allows for simpler and more convenient preparation of an artificial biomembrane structure on a substrate using a lipid material, by using a plurality of transparent microwells formed on the substrate, and observation inside the microwells. In addition, a spherical 3D artificial single bilayer structure may be sealed very tightly through a simple method of changing the frequency of an electric field applied vertically to the microwells having a lipid layer formed. Through this, a biomimetic 3D structure having the structural and/or functional characteristics of a cell membrane constituting a cell can be provided more effectively.

16 Claims, 10 Drawing Sheets

PREPARING METHOD OF TIGHTLY SEALED 3D LIPID STRUCTURE AND TIGHTLY SEALED 3D LIPID STRUCTURE PREPARED THEREBY

CROSS-REFERENCE TO RELATED APPLICATIONS

This application claims, under 35 U.S.C. § 119, the priority of Korean Patent Application No. 10-2018-0110772 filed on Sep. 17, 2018 in the Korean Intellectual Property Office, the disclosure of which is incorporated herein by reference in its entirety.

TECHNICAL FIELD

The present disclosure relates to a method for preparing a tightly sealed 3D lipid structure and a method for sealing the same. In particular, it relates to a biomimetic 3D structure which has structural and/or functional characteristics of a cell membrane constituting a cell and senses a biomaterial or a biological signal, more particularly to a method for preparing a 3D biomembrane structure that can be used as a device at a specific position on a substrate and a sealing method for completely separating the inside and outside of the prepared structure.

BACKGROUND

A cell performs functions for maintaining biological phenomena such as sensing of environmental change, regulation and communication between inside and outside of the cell. At the core of these functions lie an amphiphilic lipid bilayer (unilamellar membrane) with a thickness of about 5-10 nm and a membrane protein including an ion channel protein. Despite the fast development in biotechnology, the biochemical analysis of the membrane protein fixed to the surface of the cell is difficult with the standard analysis method optimized for water-soluble proteins due to the hydrophobic region at the center of the lipid bilayer.

For analysis of the membrane protein or development of a new-concept biosensor using the membrane protein, the development of an analytical platform made of an artificial lipid structure is essential. For this, attempts are made to fabricate 1) a 3D liposome or giant unilamellar vesicle (GUV) consisting of an artificial lipid membrane (or reconstituted lipid membrane) mimicking the function and structure of a cell and a membrane protein or 2) a freestanding lipid bilayer formed in a void space without a 2D supporting surface for application as a biosensor device.

The GUV is very similar to the structure of the real cell because it maintains the form of a bilayer separating the inside and outside of the cell and, thus, is optimized for model experiments mimicking the various functions of a cell membrane. However, because the 3D GUV is floated in various buffer solutions, an additional process of setting or fixing onto a substrate for various observations and detections is necessary. This makes it difficult to achieve a single detection region. Meanwhile, the 2D freestanding lipid bilayer uses small apertures on a solid substrate as for supporting, which enables observation and detection in a single detection region possible by preparing a bilayer array without an additional process and makes it highly applicable as a sensor. However, because this structure is unsatisfactory in terms of membrane stability, attempts are made to minimize the area of bilayer formation by reducing the size of the apertures from several micrometers to hundreds of nanometers or to improve stability by reinforcing the top and bottom space of the bilayer using a suitable porous polymer material such as a hydrogel in the form of a sandwich.

Recently, attempts are made to prepare a 3D, not 2D, lipid structure fixed on a substrate. Takeuchi et al. of Tokyo University fabricated lipid structure arrays with dome and vesicle shapes on the surface of ITO glass using 1-μm deep wells. However, the dome-shaped structure is disadvantageous in that unwanted material transfer occurs between inside and outside due to incomplete sealing and the vesicle-shaped structure is disadvantageous in that it is detached from the substrate. Also, Majd et al. of Pennsylvania State University fabricated a 10-70 μm sized GUV by transferring a lipid pattern onto an ITO glass substrate using a hydrogel stamp and then conducting electroforming by applying an electric field. Although this lipid structure is attached to the surface of the ITO, sealing is not achieved as the material transports through the nanoholes of a tether and the structure is detached easily if the frequency of the AC electric field is decreased. That is to say, in order to mimic the core function of the cell membrane, i.e., the sensing of a biological signal, it is essential to fabricate a 3D artificial biomembrane structure having sufficient reaction area and high stability on a substrate using a lipid material constituting the actual cell membrane. And, for actual model experiments or application to sensors, the fabricated 3D artificial biomembrane structure should be sealed completely. However, tight sealing of a 3D artificial biomembrane structure formed to be fixed on a substrate has not been developed. In addition, although complete sealing with the structure fixed at a desired position and spaced enough from the substrate is necessary, such objective is not achieved yet.

The inventors of the present disclosure have invented a method for manufacturing a lipid structure, including: a step of preparing a microwell array having a plurality of microwells formed on a substrate; a step of forming a lipid layer by injecting a lipid solution into the microwells and drying the same; and a step of forming a 3D structure from the lipid layer on the microwell by performing hydration by adding a buffer solution onto the microwell having the lipid layer formed (Korean Patent Application No. 10-2017-0110796). However, this method is problematic in that the inside of the microwell cannot be observed because an opaque silicon substrate is used and the fixed 3D lipid structure cannot be sealed completely.

REFERENCES OF RELATED ART

Patent Document

Korean Patent Application No. 10-2017-0110796.

SUMMARY

The present disclosure has been made to solve the problems described above and is directed to preparing a 3D artificial biomembrane structure having enough reaction area and high stability on a substrate using a lipid material and providing a method for separating the inside and outside of the 3D artificial biomembrane structure through complete sealing of the 3D artificial biomembrane structure, thereby allowing sensing of a biological signal. That is to say, the present disclosure is directed to providing a 3D artificial single bilayer structure capable of sensing a biological signal more effectively by maintaining tight sealing, thereby preventing leakage that may occur when a 3D structure formed of a lipid membrane is formed on a substrate.

An aspect of the present disclosure relates to a method for preparing a sealed lipid structure, which includes: a step of preparing a microwell array having a plurality of microwells formed on one side of a substrate; a step of forming a lipid layer by injecting a liposome solution into the microwells and drying the same; a step of forming a 3D structure from the lipid layer onto the microwells through electroforming whereby an electric field is applied while the lipid layer is hydrated by adding a buffer solution onto the microwells; and a step of sealing the 3D structure by controlling frequency while applying the electric field.

Another aspect of the present disclosure relates to a sealed lipid structure containing: a microwell array having a plurality of microwells formed on one side of a substrate; a lipid layer formed by injecting a liposome solution into the microwells and drying the same; and a 3D structure formed from the lipid layer onto the microwells through electroforming.

A method for preparing a tightly sealed 3D lipid structure of the present disclosure allows for simpler and more convenient preparation of an artificial biomembrane structure on a substrate using a lipid material, by using a plurality of transparent microwells formed on the substrate, and observation inside the microwells.

In addition, a spherical 3D artificial single bilayer structure may be sealed very tightly through a simple method of changing the frequency of an electric field applied vertically to the microwells having a lipid layer formed.

The tightly sealed 3D lipid structure prepared by the present disclosure has an effect of mimicking the sensing of a biological signal, which is the core function of a cell membrane, through a lipid membrane of a biomimetic 3D structure having the structural and functional characteristics of a cell membrane constituting a cell.

DETAILED DESCRIPTION OF EMBODIMENTS

The present disclosure can be changed variously and may have various exemplary embodiments. The exemplary embodiments are illustrated in the attached drawings and described in detail in the detailed description. However, the present disclosure is not limited to specific exemplary embodiments and should be understood to include all changes, equivalents or substitutes included in the technical idea and scope of the present disclosure. When it is determined that a detailed description of known art may make the gist of the present disclosure ambiguous, the detailed description thereof will be omitted.

The terms used in the present disclosure are used merely to describe specific exemplary embodiments and are not intended to limit the present disclosure. A singular expression includes a plural expression unless the context clearly indicates otherwise. In the present disclosure, the terms such as "include", "contain", "have", etc. should be understood as designating that the features, numbers, steps, operations, elements, parts or combinations thereof described in the specification exist and not as precluding the existence of or the possibility of adding one or more other features, numbers, steps, operations, elements, parts or combinations thereof in advance.

Although the terms first, second, etc. may be used to describe various elements, these elements should not be limited by the terms. The terms are used only to distinguish one element from another.

Figure 1:
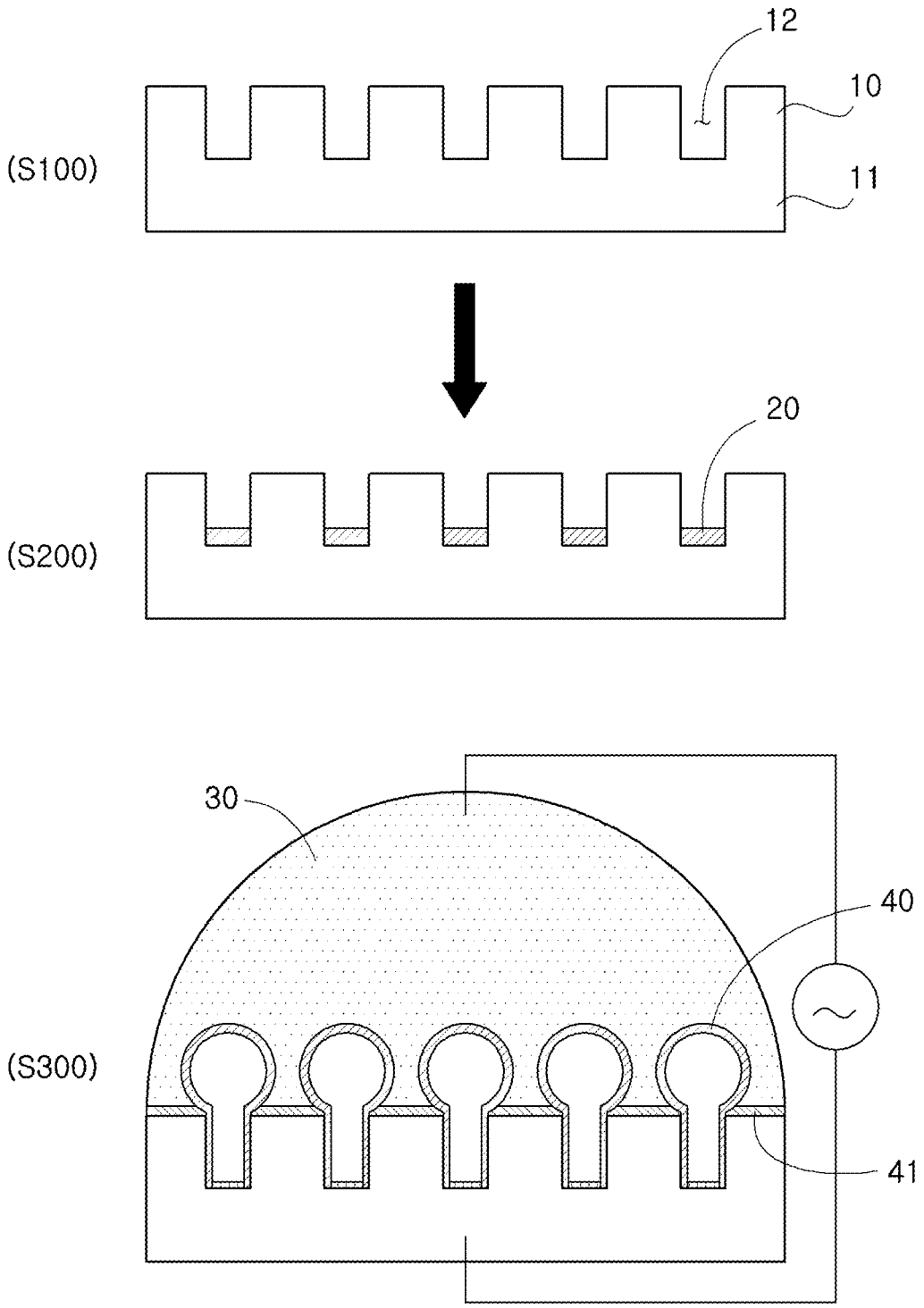
FIG. 1 is a flow diagram illustrating a method for preparing a sealed lipid structure according to an exemplary embodiment of the present disclosure.

FIG. 1 is a flow diagram illustrating a method for preparing a lipid structure according to a specific exemplary embodiment of the present disclosure.

As shown in FIG. 1, an aspect of the present disclosure provides a method for preparing a sealed lipid structure, which includes: a step of preparing a microwell array 10 having a plurality of microwells 12 formed (S100); a step of forming a lipid layer 20 by injecting a liposome solution 22 into the microwells 12 and drying the same (S200); a step of forming a 3D structure 40 from the lipid layer 20 onto the microwells 12 through electroforming whereby an electric field is applied while the lipid layer 20 is hydrated by adding a buffer solution 30 onto the microwells 12 (S300); and a step of sealing the 3D structure 40 by controlling frequency while applying the electric field.

In an exemplary embodiment of the present disclosure, the step of preparing the microwell array 10 (S100) may include: a step of forming a photoresist film 13 by coating a photoresist on a substrate 11 (S20); a step of positioning a mask 14 on the photoresist film 13 and exposing to light (S30); and a step of forming the microwell array 10 by developing the photoresist film 13 (S40).

In another exemplary embodiment of the present disclosure, the microwell array may be a transparent polymer.

In the step of preparing the microwell array (S100), a microwell array having a plurality of microwells formed on a substrate may be prepared. The substrate is a support for forming a lipid structure thereon and includes any one known in the related art without special limitation. For example, the substrate may be a plate or substrate including silicon and a polymer material patterned thereon. The microwell is a space for forming a lipid layer by filling a lipid solution therein. The shape of the microwell is not specially limited. For example, it may have a tetragonal cross section and may have a cylindrical shape. The plurality of microwells may be arranged on a substrate with regular intervals.

Figure 2:
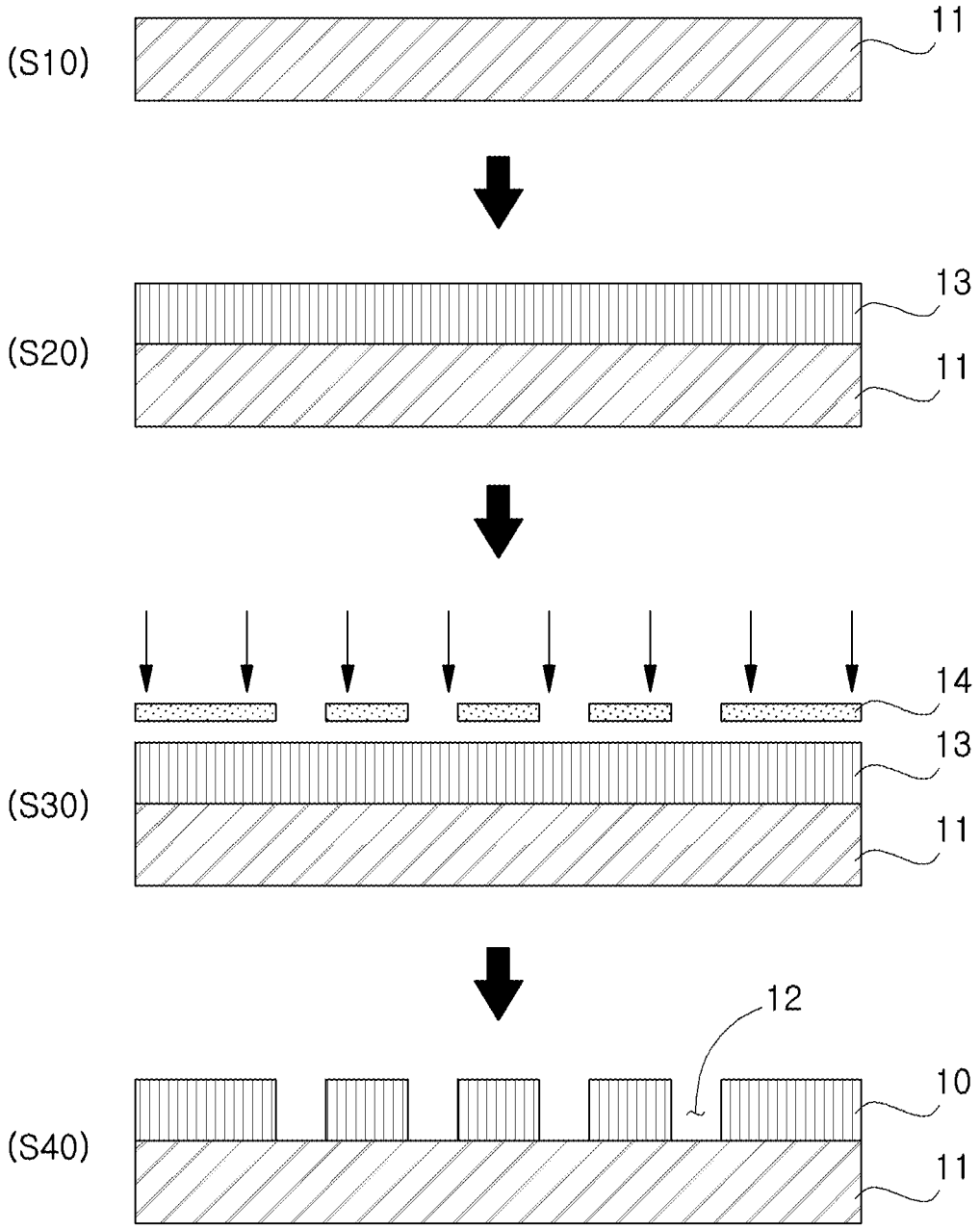
FIG. 2 is a flow diagram illustrating a step of preparing a microwell array according to an exemplary embodiment of the present disclosure.
Figure 3:
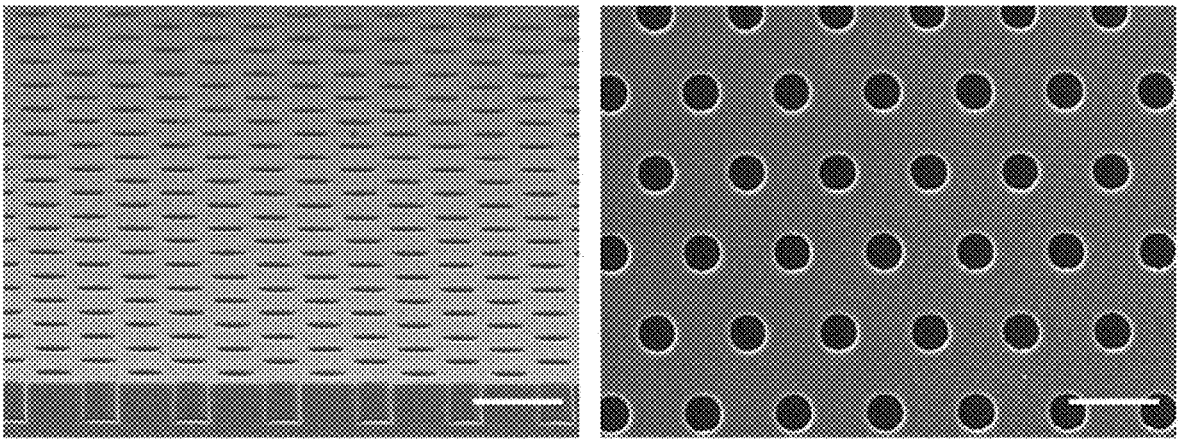
FIG. 3 shows scanning electron microscopic (SEM) images of a microwell array containing microwells according to the present disclosure (scale bar: 20 μm).

FIG. 2 is a flow diagram illustrating the step of preparing the microwell array (S100) according to an exemplary embodiment of the present disclosure and FIG. 3 shows scanning electron microscopic (SEM) images of the microwell array containing a plurality of microwells according to an exemplary embodiment of the present disclosure (scale bar: 20 μm).

A method of forming a plurality of microwells on a substrate is not specially limited. For example, as shown in FIG. 2, a silicon substrate 11 is prepared (S10) and then a photoresist film 13 is formed by coating a photoresist thereon (S20). Then, a chromium mask 14 is positioned on the photoresist film and light exposure is conducted by a lithography process (S30). Subsequently, a microwell array 10 is formed by patterning the photoresist film 13 through development (S40). As a result, transparent microwells may be formed as shown in FIG. 3.

The photoresist is not specially limited as long as it is one capable of forming a microwell array having an appropriate thickness. Specifically, SU-8 (epoxy-based negative resist) may be used because SU-8 is transparent and makes it easy to observe the inside of the microwells.

In another exemplary embodiment of the present disclosure, the microwell 12 may have a diameter of 1-20 μm, an aspect ratio (=depth/diameter) of 0.2-10.0 and a pitch of 10-100 μm.

In another exemplary embodiment of the present disclosure, the liposome solution 22 is prepared by: a step of drying a lipid solution 21 wherein a lipid is dissolved in an organic solvent; and a step of preparing a liposome solution 22 by adding an aqueous solution to the dried lipid solution 21 (S120).

In another exemplary embodiment of the present disclosure, the liposome solution 22 may be a deionized (DI) water solution containing a liposome or a small unilamellar vesicle (SUV) and may contain a lipid at a concentration of 1-100 mM.

In another exemplary embodiment of the present disclosure, the step of forming the lipid layer 20 may include: a step of adding the liposome solution 22 to the surface of the microwell array 10; a step of positioning a glass blade 24 on the microwell array 10 to which the liposome solution 22 has been added and injecting the liposome solution 22 into the microwells 12 by moving the glass blade 24 with a constant speed; and a step of forming the lipid layer 20 by drying the microwell array 10 into which the liposome solution 11 has been injected, and the step of injecting the liposome solution 22 may include: a step of controlling a contact angle of the substrate 11 and the liposome solution 22 by treating the surface of the microwell array with a silane 23; and a step of adding the liposome solution 22 to the microwell array 10 having the contact angle controlled.

In another exemplary embodiment of the present disclosure, the drying may be performed at a temperature of −10 to −80° C. under a pressure of 1-10 mTorr for 2-24 hours.

Figure 4:
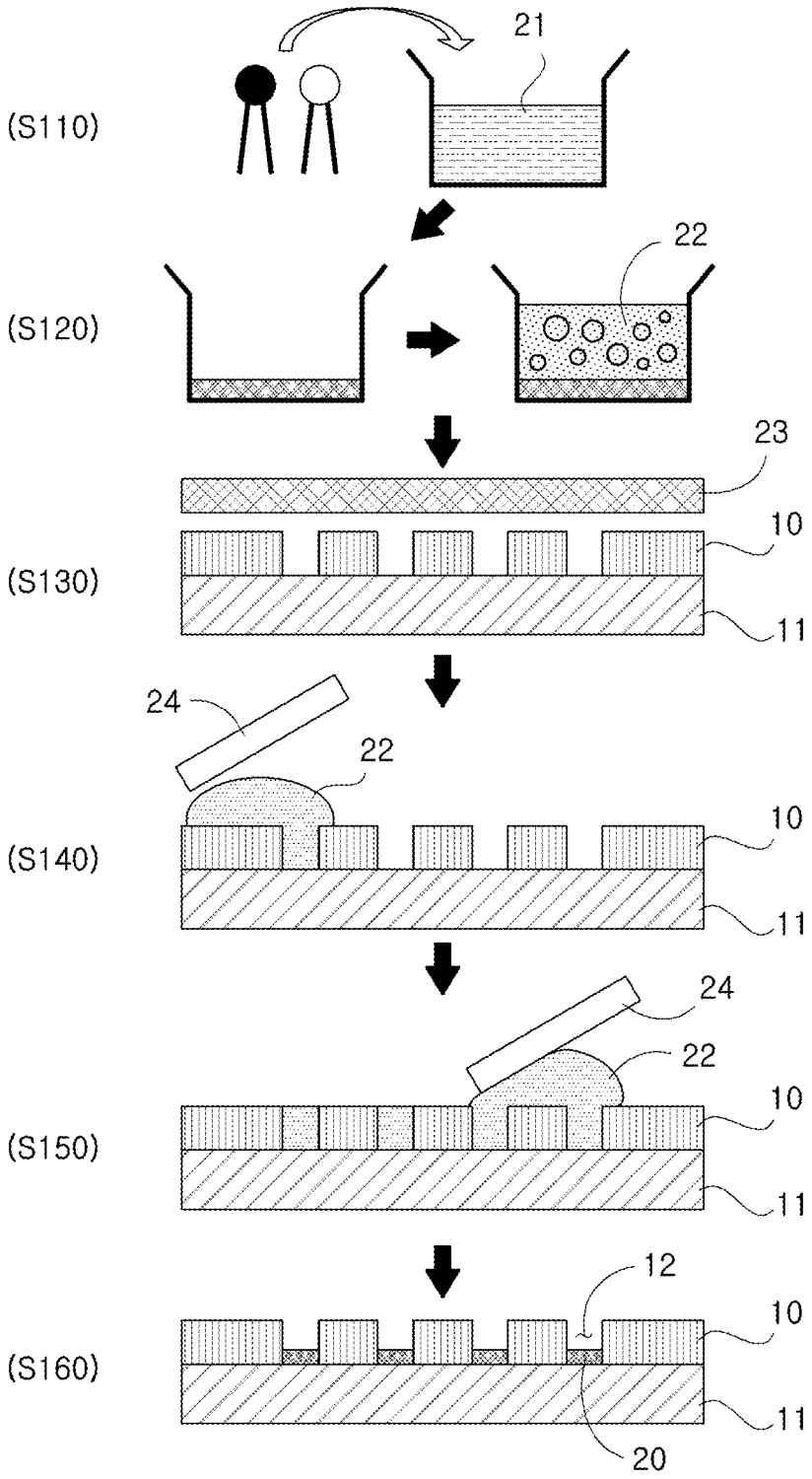
FIG. 4 is a flow diagram illustrating a step of forming a lipid layer according to an exemplary embodiment of the present disclosure.
Figure 5:
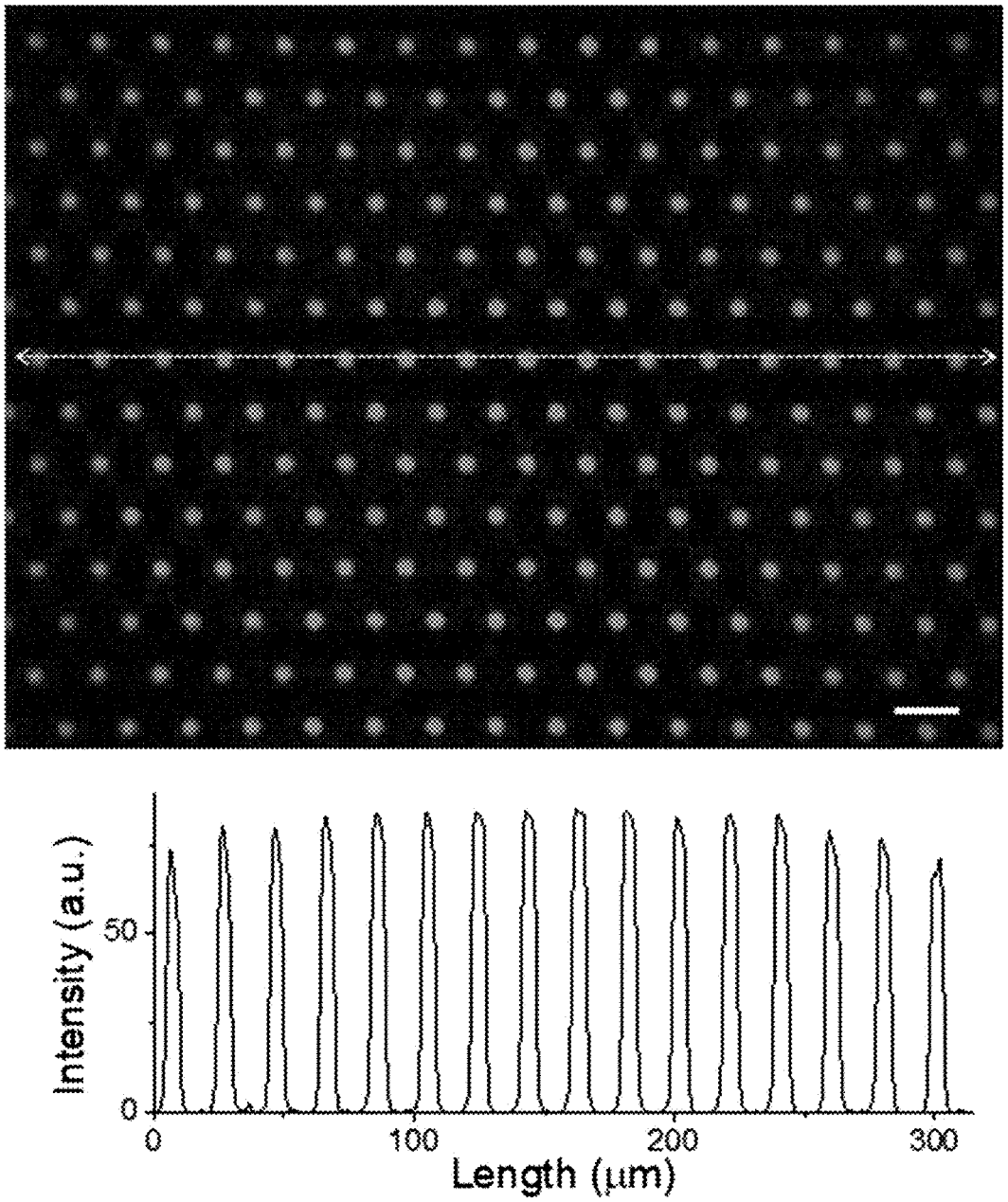
FIG. 5 is a fluorescence microscopic image of a lipid layer formed inside microwells of a microwell array according to the present disclosure (scale bar: 20 μm).

FIG. 4 is a flow diagram illustrating the step of forming the lipid layer (S200) according to an exemplary embodiment of the present disclosure and FIG. 5 is a fluorescence microscopic image of the lipid layer formed inside the microwells of the microwell array according to the present disclosure (scale bar: 20 μm).

In the step of forming the lipid layer 20 (S200), the lipid layer 20 is formed after injecting the liposome solution 22 into the microwells 12. The method of injecting the liposome solution 22 into the microwells 12 and drying the same is not specially limited.

The step of forming the lipid layer 20 (S200) may include a step of forming the liposome solution 22. First, the lipid solution 21 is prepared (S110). The lipid solution 21 may be a solution containing a lipid at a concentration of 1-50 mM, specifically 5-30 mM. As a solvent, any organic solvent that can dissolve a lipid, such as chloroform, methanol, etc. may be used without special limitation.

The lipid solution may further contain a fluorescence-labeled lipid for observation by fluorescence microscopy. As the fluorescence-labeled lipid, the lipid DOPE (1,2-dioleoyl-sn-glycero-3-phosphoethanolamine) with a fluorescence dye emitting green fluorescence (NBD) and/or red fluorescence (rhodamine B) at the head portion may be used. For example, NBD-PE (1,2-dioleoyl-sn-glycero-3-phosphoethanolamine-N-(7-nitro-2-1,3-benzoxadiazol-4-yl)) and/or Liss Rhod PE (1,2-dioleoyl-sn-glycero-3-phosphoethanolamine-N-(lissamine rhodamine B sulfonyl)) may be used in a range of 0.1-10 mol %, specifically 0.3-1.0 mol %, based on the lipid solution.

Then, the lipid solution 21 may be dried using a vacuum desiccator, etc. The liposome solution 22 containing a liposome or a small unilamellar vesicle (SUV) may be prepared by adding an aqueous solution to the dried lipid (S120). The aqueous solution is not specially limited as long as it is a buffer free from an organic solvent, such as PBS, HEPES, etc. Specifically, deionized (DI) water may be used as the aqueous solution. Whereas selective coating is difficult with other aqueous solutions, deionized water is suitable for selective coating because a contact angle with an SU-8 substrate is appropriate and, thus, the liposome solution 22 is pinned into the microwells. Accordingly, the liposome solution 22 may be prepared by the method described above.

Next, a contact angle of the surface of the substrate 11 and the liposome solution 22 may be controlled by treating the surface of the prepared microwell array 10 with a silane 23 (S130). The method for controlling the contact angle on the surface of the substrate 11 is not specially limited. For example, the contact angle may be controlled by depositing a silane such as PFOTS (trichloro(1H,1H,2H,2H-perfluorooctyl)silane), OTS (trichloro(octadecyl)silane), etc. by vapor phase deposition and/or liquid phase deposition, etc. In particular, vapor phase deposition using a vacuum desiccator is more effective because the contact angle can be controlled more safely and conveniently.

Then, the liposome solution 22 is added to the surface of the substrate 11 with the contact angle controlled (S140). The liposome solution 22 is dropped onto the substrate 11.

Then, after positioning the glass blade 24 on the microwell array 10 to which the liposome solution 22 has been added, the liposome solution 22 is injected into the microwells 12 by moving the glass blade 24 with a constant speed (S150). The liposome solution 22 may be injected selectively only into the microwells 12 by moving the liposome solution 22 with a constant speed together with the glass blade 24.

Subsequently, the lipid layer 20 is formed by drying the microwell array 10 into which the liposome solution 22 has been injected (S160). The method for drying the microwell array 10 is not specially limited. However, the drying of the microwell array 10 may be performed specifically at a temperature of −10 to −80° C., more specifically under a pressure of 1-10 mTorr for 2-24 hours. For example, the drying may be performed in a freeze dryer. The drying may be performed specifically at a temperature lower than the transition temperature (−17° C.) of DOPC (lipid), more specifically at −20 to −70° C. in order to prevent denaturation of the lipid.

FIG. 5 is the fluorescence microscopic image of a substrate selectively coated with a lipid (scale bar: 20 μm). As can be seen from the line profile of the lipid-coated substrate, the intensity is 0 except the regions of the microwells, confirming that selective coating into the microwells of the lipid was achieved well.

Next, in the step of forming the 3D structure 40 (S300), the lipid layer 20 is hydrated by adding the buffer solution 30 onto the microwells 12 having the lipid layer 20 formed and the 3D structure 40 is from the lipid layer 20 onto the microwells 12. The buffer solution is for hydrating the lipid layer and is not particularly limited. For example, PBS (phosphate buffered saline) may be used. Specifically, deionized (DI) water containing sucrose may be used. The deionized water containing sucrose is preferred in that it is the simplest solvent that may be used regardless of pH, ion concentration, etc. In the process of hydrating the lipid layer by adding the buffer solution, the 3D lipid structure having a single bilayer structure may be formed by electroforming by applying an AC voltage.

Basically, a lipid is an amphiphilic molecule having hydrophilic and hydrophobic groups at the same time. A bilayer is formed as the hydrophilic head portion faces outward and the hydrophobic tail portion faces inward. A dried lipid layer is formed as several lipid bilayers are stacked. When a buffer is added thereto, osmotic pressure is generated as water molecules infiltrate between the lipid bilayers and, as a result, the lipid layers are separated.

As the method of preparing the lipid structure by hydrating the lipid layer, various previously known methods may be used. For example, a method of preparing a spherical lipid structure such as a giant unilamellar vesicle (GUV), etc. by coating a lipid film on a solid substrate 11 such as glass and then hydrating the lipid film by adding a buffer ("Giant Vesicles: Preparations and Applications", *ChemBioChem* 2010, 11, 845-865, "Liposomes: Technologies and Analytical Applications", *Annu. Rev. Anal. Chem.* 2008, 1, 801-832) may be used.

Figure 6:
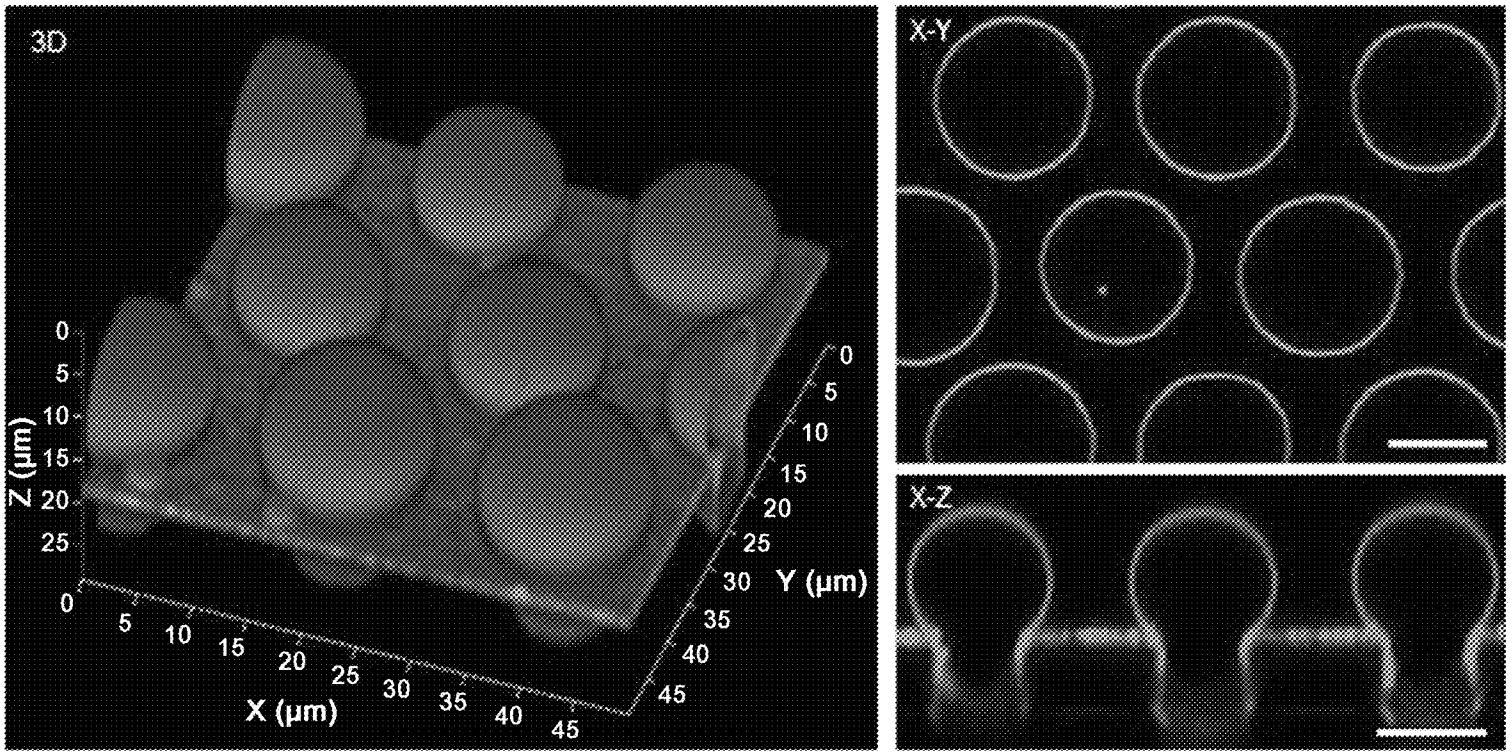
FIG. 6 shows confocal fluorescence microscopic images of a spherical structure formed by applying an electric field to a lipid layer according to the present disclosure (scale bar: 10 μm).

FIG. 6 shows confocal fluorescence microscopic images of a spherical structure formed by applying an electric field to a lipid layer according to the present disclosure (scale bar: 10 μm). As can be seen from FIG. 6, the surface is covered with a self-spreading bilayer and the lipid single bilayer 3D structure is formed from inside the microwells.

As seen from FIG. 6, when a substrate selectively coated with a liposome solution was hydrated with a buffer solution and/or deionized (DI) water containing sucrose, self-spreading of a lipid, i.e., the spreading of the lipid bilayer from inside the lipid-coated microwells, occurred. Then, when an electric field is applied to the lipid layer, the lipid layers are changed into a large single bilayer as they undergo swelling and fusion repeatedly.

Because the lipid is asymmetrical in the size of the head portion and the tail portion, when the 3D structure (generally, in the form of a long tubule) is formed, it is changed into the most stabilized structure, i.e., the structure with minimized system energy including curvature energy, or the spherical structure, with the passage of time.

The present disclosure provides an effect of preparing the spherical 3D artificial biomembrane structure on a substrate conveniently and easily by hydrating the lipid layer formed on the microwells by adding a buffer in the state where an electric field is applied vertically to the microwells having the lipid layer formed.

Next, in the step of sealing the 3D structure 40, the 3D structure 40 is sealed tightly by changing the shape of the 3D structure 40 by changing the frequency of the applied AC voltage, thereby attaching the lipid structure to the wall of the microwells 12. The method of changing the frequency and thereby changing the shape of the 3D structure will be described in more detail.

According to the present disclosure, an artificial biomembrane structure may be prepared on a substrate using a lipid material and, particularly by using a plurality of microwells formed on the substrate, a 3D structure can be prepared more conveniently and easily. In addition, a tightly sealed 3D lipid bilayer structure may be prepared by changing the shape of the 3D structure by applying an AC voltage to the 3D structure.

With the existing thermal method, electromechanical method, biological method, mechanical method, electrical method, etc. of preparing a 3D structure using a lipid material, an artificial biomembrane structure fixed on a substrate could not be prepared. In addition, the 3D lipid structure fixed on a substrate developed by some researchers could not be used as a biosensor for measuring material transport inside and outside the structure due to incomplete sealing. In addition, although the inventors of the present disclosure have previously prepared a 3D lipid structure array using silicon microwells, the sealing of the lipid structure could not be identified because the inside of the microwells could not be observed due to the opacity of the silicon substrate. As a result of researches and efforts for a long period of time, the inventors of the present disclosure have identified that, by using a plurality of microwells formed using a transparent polymer, the 3D structure fixed on the substrate can be observed more precisely and, through this, a lipid membrane structure having a tubular or spherical (vesicular) shape, capable of sensing a biological signal more effectively, can be prepared more firmly and easily on the substrate through tight sealing, and have completed the present disclosure.

Figure 7:
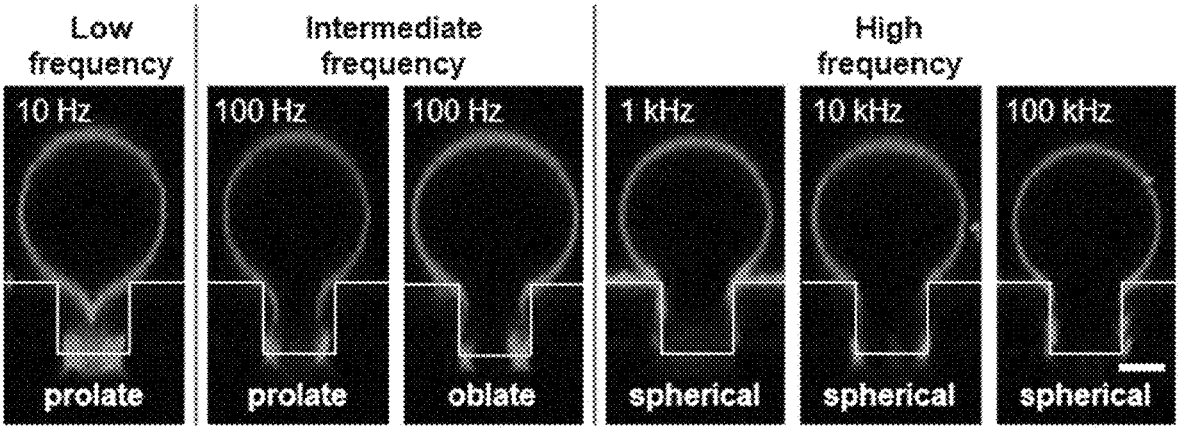
FIG. 7 shows confocal fluorescence microscopic images showing the shape change of a 3D structure according to the present disclosure depending on change in frequency (scale bar: 5 μm).

FIG. 7 shows confocal fluorescence microscopic images showing the shape change of a 3D structure according to the present disclosure depending on change in frequency (scale bar: 5 μm).

As described above, according to the present disclosure, a spherical 3D artificial biomembrane structure may be formed on a substrate by hydrating the lipid layer formed on microwells by adding a buffer while applying an electric field vertically and the shape change of the 3D lipid structure depending on the frequency of the applied electric field can be observed.

The inventors of the present disclosure used the following equation in order to standardize or normalize the shape change of the 3D lipid structure. That is to say, a Maxwell-Wagner frequency ($\omega_{MW}$) and a capacitor charging frequency ($\omega_c$), which are the frequencies indicating the shape change of the 3D lipid structure, were calculated using the conductivity ($\lambda$) and dielectric constant ($\varepsilon$) of the buffer solution added for the hydration, the radius of the formed 3D lipid structure (R) and the membrane capacitance ($C_m$).

$$\omega_{MW} = \frac{\lambda_{in} + 2\lambda_{ex}}{\epsilon_{in} + 2\epsilon_{ex}} \quad \text{[Equation 1]}$$

(Maxwell-Wagner frequency: $\omega_{MW}$, conductivity of the inside solution: $\lambda_{in}$, conductivity of the outside solution: $\lambda_{ex}$, dielectric constant of the inside solution: $\varepsilon_{in}$, dielectric constant of the outside solution: $\varepsilon_{ex}$)

$$\omega_e = \frac{1}{RC_m}\left(\frac{2\lambda_{in}\lambda_{ex}}{\lambda_{in} + 2\lambda_{ex}}\right) \quad \text{[Equation 2]}$$

(capacitor charging frequency: $\omega_c$, radius of the 3D lipid structure: R, membrane capacitance: $C_m$, conductivity of the inside solution: $\lambda_{in}$, conductivity of the outside solution: $\lambda_{ex}$)

When the 3D lipid structure is formed at a frequency (low frequency) lower than the capacitor charging frequency ($\omega_c$), the formed 3D structure is changed into a prolate shape due to a vertical force. When the 3D lipid structure is formed at a frequency (intermediate frequency) between the capacitor charging frequency ($\omega_c$) and the Maxwell-Wagner frequency ($\omega_{MW}$), a prolate shape and an oblate shape are observed simultaneously as vertical and horizontal forces are applied to the formed 3D structure. When the 3D lipid structure is formed at a frequency (high frequency) higher than the Maxwell-Wagner frequency ($\omega_{MW}$), the formed 3D structure has a spherical shape.

When the inside of the microwells of the 3D lipid structures formed at various frequencies is observed by confocal fluorescence microscopy, the inside of the lipid structure becomes narrow if it has a prolate shape and the inside of the lipid structure becomes wide if it has an oblate or spherical shape. It was observed by confocal fluorescence microscopy that the lipid structure with a wide microwell is attached to the microwell.

Figure 8:
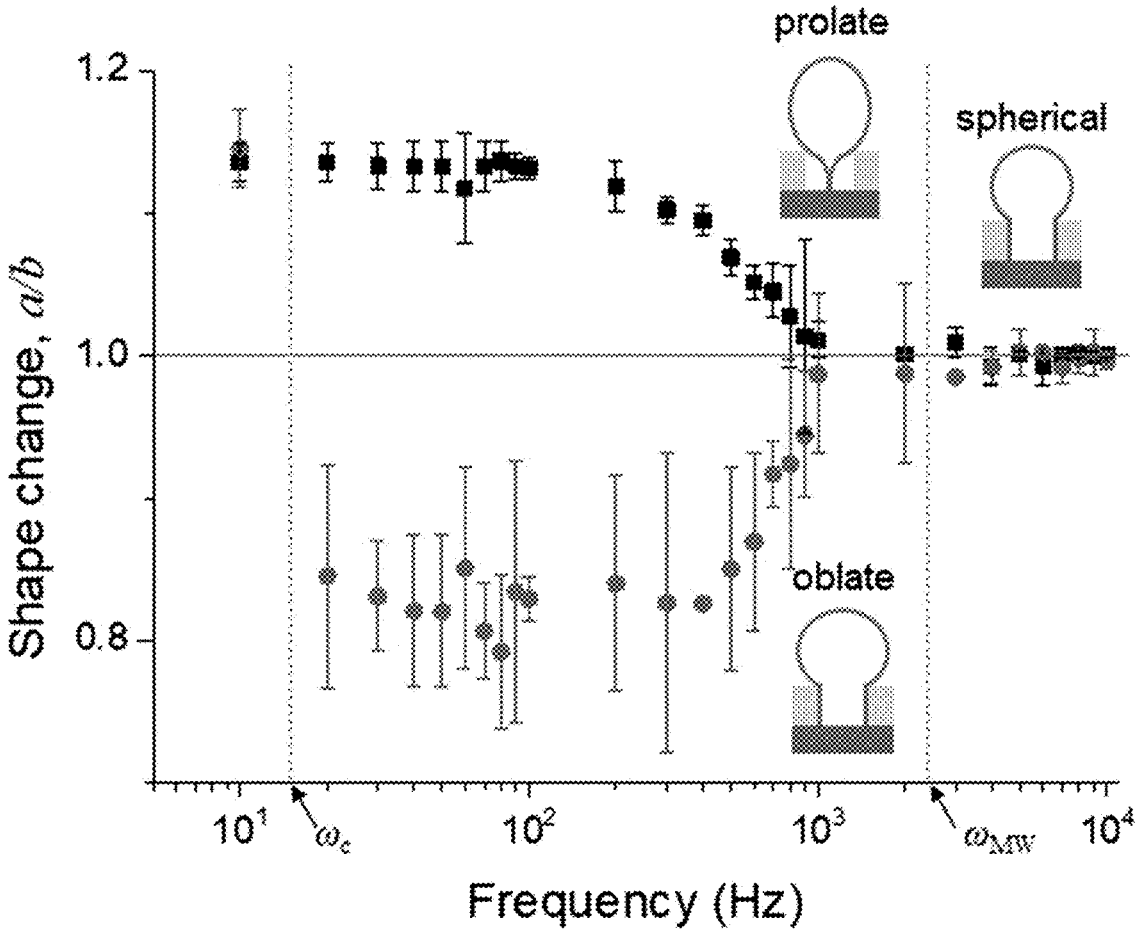
FIG. 8 shows the shape change of a 3D lipid structure depending on the change in the frequency of an electric field applied to the 3D structure according to the present disclosure, calculated by a ratio of the vertical radius (a) and horizontal radius (b) of the 3D lipid structure.

FIG. 8 shows the shape change of the 3D lipid structure depending on the change in the frequency of the applied electric field, calculated by a ratio of the vertical radius (a) and horizontal radius (b) of the 3D lipid structure. In the graphs of FIG. 8, each data point indicates the 3D lipid structure hydrated with deionized (DI) water containing 10 mM sucrose. Also, in the graphs of FIG. 8, each data point shows a result of observing the change of the 3D lipid structure depending on frequency. For example, the black squares indicate the 3D lipid structures changed to prolate shapes at intermediate frequencies and the red circles indicate the 3D lipid structures changed to oblate shapes at intermediate frequencies.

From the graphs, the frequency at which the shape of the 3D structure of the present disclosure is changed can be identified. It can be seen that the capacitor charging frequency ($\omega_c$) at which a prolate shape is changed to an oblate shape is 15 Hz and the Maxwell-Wagner frequency ($\omega_{MW}$) at which a prolate shape is changed to a spherical shape is 1 kHz. Specifically, the 3D structure of the present disclosure is tightly sealed as the lipid structure inside the microwells expands and is attached to the wall of the microwells at a frequency higher than the Maxwell-Wagner frequency ($\omega_{MW}$) according to Equation 1.

$$\omega_{MW} = \frac{\lambda_{in} + 2\lambda_{ex}}{\epsilon_{in} + 2\epsilon_{ex}} \quad \text{[Equation 1]}$$

In Equation 1, $\lambda_{in}$ is the conductivity inside the 3D structure, $\lambda_{ex}$ is the conductivity outside the 3D structure, $\varepsilon_{in}$ is the dielectric constant inside the 3D structure and $\varepsilon_{ex}$ is the dielectric constant outside the 3D structure.

Figure 9:
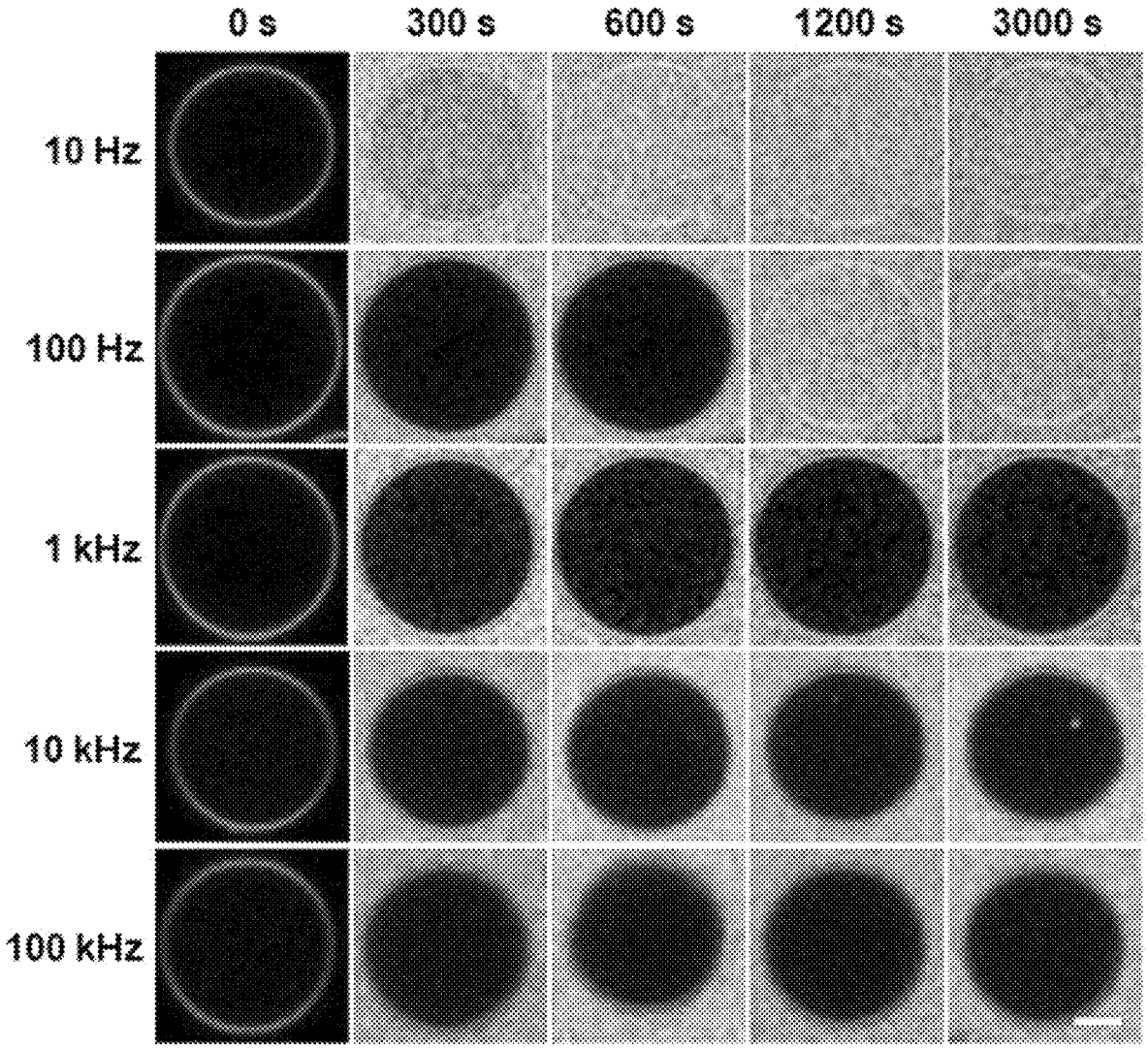
FIG. 9 shows confocal fluorescence microscopic images showing whether 3D lipid structures formed at different frequencies according to the present disclosure are sealed tightly depending on time (scale bar: 5 μm).

FIG. 9 shows confocal fluorescence microscopic images showing whether 3D lipid structures formed at different frequencies according to the present disclosure are sealed tightly depending on time (scale bar: 5 μm).

In order to effectively evaluate the tight sealing of the 3D lipid structure, the inventors of the present disclosure have injected a fluorescence dye into 3D lipid structures formed at different frequencies through a microfluidic channel and investigated the inflow of the fluorescence dye into the 3D lipid structures.

As can be seen from FIG. 9, the structure formed at 10 Hz, which is lower than the capacitor charging frequency ($\omega_c$), was not sealed because the fluorescence dye was instantly introduced into the structure. The structure formed at 100 Hz, which is between the capacitor charging frequency ($\omega_c$) and the Maxwell-Wagner frequency ($\omega_{MW}$), maintained sealing initially but, after a predetermined time, the fluorescence dye was introduced into the structure, which shows that tight sealing was not achieved. For the structure formed at a frequency higher than the Maxwell-Wagner frequency ($\omega_{MW}$) (>1 kHz), the fluorescence dye was not introduced into the structure with time. Through this, it was confirmed that the tight sealing of the 3D lipid structure according to the present disclosure is achieved at the Maxwell-Wagner frequency ($\omega_{MW}$) or higher.

Figure 10:
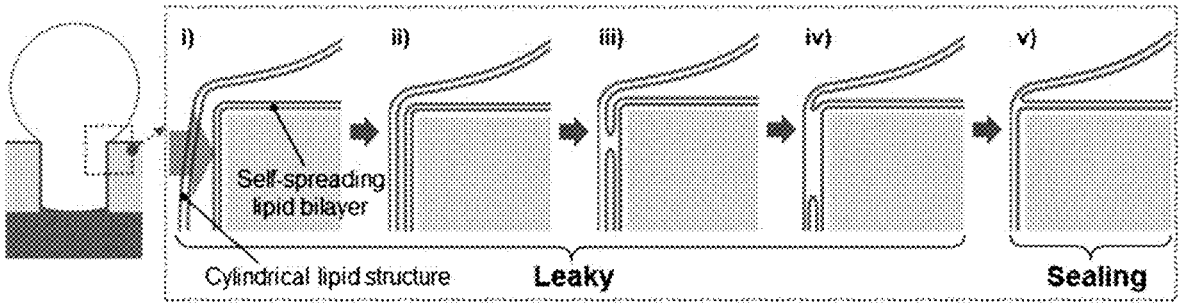
FIG. 10 schematically illustrates a process whereby a 3D lipid structure according to the present disclosure is sealed tightly through fusion with a self-spreading bilayer.
Figure 11:
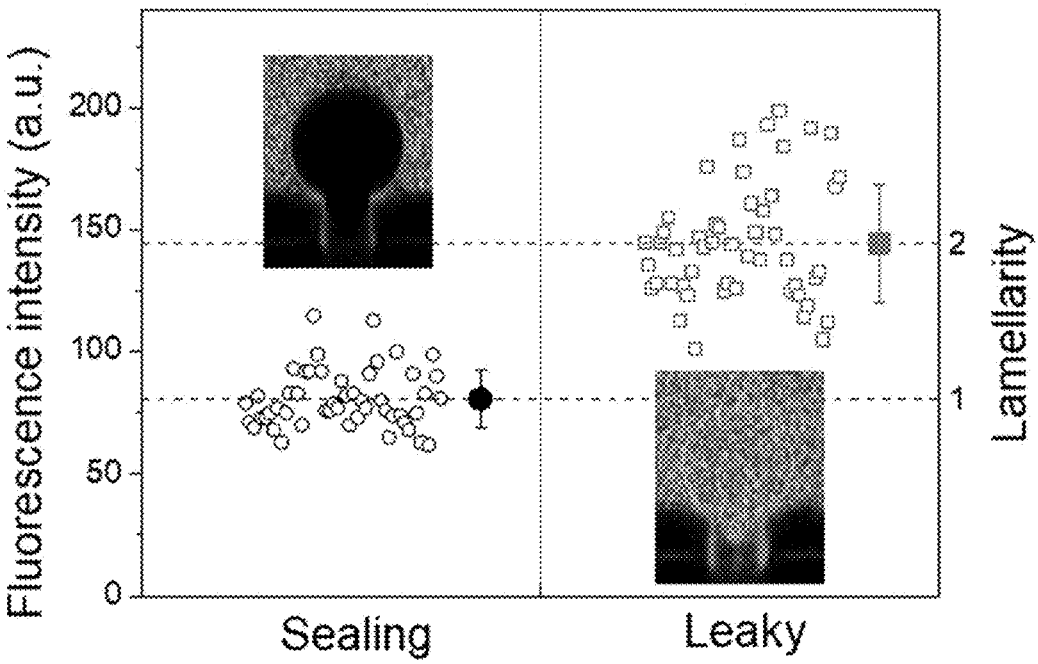
FIG. 11 shows a result of investigating tight sealing of a 3D lipid structure according to the present disclosure and a self-spreading bilayer through fusion by observing a lipid layer on the wall of a microwell by confocal fluorescence microscopy.

FIG. 10 schematically illustrates a process whereby a 3D lipid structure according to the present disclosure is sealed tightly through fusion with a self-spreading bilayer and FIG. 11 shows a result of investigating tight sealing of a 3D lipid structure according to the present disclosure and a self-spreading bilayer through fusion by observing a lipid layer on the wall of a microwell by confocal fluorescence microscopy.

As described above, when the 3D lipid structure is formed at a frequency higher than the Maxwell-Wagner frequency ($\omega_{MW}$), the structure expands inside the microwells and is attached to the wall of the microwells. Then, the structure contacts the self-spreading bilayer present on the surface of the microwells as it expands consistently and fusion occurs around the contact site. Subsequently, the fused region is extended and the 3D lipid structure is completely fused with the self-spreading bilayer, thereby forming a single bilayer structure and leading to tight sealing.

In order to confirm this tight sealing experimentally, the inventors of the present disclosure have used the existing method of investigating the number of layers (lamellarity) through the fluorescence intensity of the lipid membrane ("Preparation of giant liposomes in physiological conditions and their characterization under an optical microscope", *Biophysical Journal* 1996, 71, 3242-3250). The intensity of the lipid structure inside the microwells, either sealed or unsealed, was measured by confocal fluorescence microscopy. The sealed single bilayer had an intensity of 80.74 and the unsealed lipid structure had an intensity of 144.60. Through this, it was confirmed that the 3D lipid structure is sealed tightly when the 3D lipid structure is fused with the self-spreading bilayer to form the single bilayer.

The present disclosure allows for simpler and more convenient preparation of an artificial biomembrane structure on a substrate using a lipid material, by using a plurality of transparent microwells formed on the substrate, and observation inside the microwells. In addition, a spherical 3D artificial single bilayer structure may be sealed very tightly through a simple method of changing the frequency of an electric field applied vertically to the microwells having a lipid layer formed.

Another aspect of the present disclosure provides a sealed lipid structure, which contains: a microwell array having a plurality of microwells formed on one side of a substrate; a lipid layer formed by injecting a liposome solution into the microwells and drying the same; and a 3D structure formed from the lipid layer onto the microwells through electroforming.

In an exemplary embodiment of the present disclosure, the microwell array may be a transparent polymer, and the microwell may have a diameter of 1-20 μm, an aspect ratio (=depth/diameter) of 0.2-10.0 and a pitch of 10-100 μm.

In another exemplary embodiment of the present disclosure, the 3D structure may be a spherical structure formed of a single bilayer.

In another exemplary embodiment of the present disclosure, the electroforming may include applying a frequency equal to or higher than a Maxwell-Wagner frequency (Maxwell-Wagner frequency; $\omega_{MW}$) according to Equation 1:

$$\omega_{MW} = \frac{\lambda_{in} + 2\lambda_{ex}}{\epsilon_{in} + 2\epsilon_{ex}} \quad \text{[Equation 1]}$$

In Equation 1, $\lambda_{in}$ is the conductivity inside the 3D structure, $\lambda_{ex}$ is the conductivity outside the 3D structure, $\varepsilon_{in}$ is the dielectric constant inside the 3D structure and $\varepsilon_{ex}$ is the dielectric constant outside the 3D structure.

The tightly sealed 3D lipid structure prepared by the present disclosure has an effect of mimicking the sensing of a biological signal, which is the core function of a cell membrane, through a lipid membrane of a biomimetic 3D structure having the structural and functional characteristics of a cell membrane constituting a cell.

While the specific exemplary embodiments of the present disclosure have been shown and described, it will be understood by those having ordinary skill in the art that various changes in form and details may be made to the features of the present disclosure without departing from the scope of this disclosure as defined by the appended claims.

DETAILED DESCRIPTION OF MAIN ELEMENTS

10: microwell array
11: substrate
12: microwell
13: photoresist film
14: mask
20: lipid layer
21: lipid solution
22: liposome solution
23: silane
24: glass blade
30: buffer solution
40: 3D structure
41: self-spreading bilayer

What is claimed is:

1. A method for preparing a sealed lipid structure, comprising:

a step of preparing a microwell array having a plurality of microwells formed on one side of a substrate;

a step of forming a lipid layer by injecting a liposome solution into the microwells and drying the same;

a step of forming a 3D structure from the lipid layer onto the microwells through electroforming whereby an electric field is applied while the lipid layer is hydrated by adding a buffer solution onto the microwells; and a step of sealing the 3D structure by controlling frequency while applying the electric field, wherein the frequency is between 1 kHz and 100 kHz.

2. The method for preparing a sealed lipid structure according to claim 1, wherein the step of preparing the microwell array comprises:

a step of forming a photoresist film by coating a photoresist on a substrate;

a step of positioning a mask on the photoresist film and exposing to light; and a step of forming the microwell array by developing the photoresist film.

3. The method for preparing a sealed lipid structure according to claim 1, wherein the microwell array is a transparent polymer.

4. The method for preparing a sealed lipid structure according to claim 1, wherein the microwell has a diameter of 1-20 μm.

5. The method for preparing a sealed lipid structure according to claim 1, wherein the microwell has an aspect ratio (=depth/diameter) of 0.2-10.0.

6. The method for preparing a sealed lipid structure according to claim 1, wherein the plurality of microwells have a pitch of 10-100 μm.

7. The method for preparing a sealed lipid structure according to claim 1, wherein the liposome solution is prepared by:

a step of drying a lipid solution wherein a lipid is dissolved in an organic solvent; and a step of preparing a liposome solution by adding an aqueous solution to the dried lipid solution.

8. The method for preparing a sealed lipid structure according to claim 1, wherein the liposome solution is a deionized (DI) water solution comprising a liposome or a small unilamellar vesicle (SUV).

9. The method for preparing a sealed lipid structure according to claim 1, wherein the liposome solution comprises a lipid at a concentration of 1-100 mM.

10. The method for preparing a sealed lipid structure according to claim 1, wherein the step of forming the lipid layer comprises:

a step of adding the liposome solution to the surface of the microwell array;

a step of positioning a glass blade on the microwell array to which the liposome solution has been added and injecting the liposome solution into the microwells by moving the glass blade with a constant speed; and a step of forming the lipid layer by drying the microwell array into which the liposome solution has been injected.

11. The method for preparing a sealed lipid structure according to claim 10, wherein the step of injecting the liposome solution comprises:

a step of controlling a contact angle of the substrate and the liposome solution by treating the surface of the microwell array with a silane; and a step of adding the liposome solution to the microwell array having the contact angle controlled.

12. The method for preparing a sealed lipid structure according to claim 1, wherein the drying is performed at a temperature of −10 to −80° C.

13. The method for preparing a sealed lipid structure according to claim 1, wherein the drying is performed under a pressure of 1-10 mTorr for 2-24 hours.

14. The method for preparing a sealed lipid structure according to claim 1, wherein the buffer solution is deionized (DI) water comprising sucrose.

15. The method for preparing a sealed lipid structure according to claim 1, wherein the 3D structure is a spherical structure comprising a single bilayer.

16. The method for preparing a sealed lipid structure according to claim 1, wherein the frequency is equal to or higher than a Maxwell-Wagner frequency ($\omega_{MW}$) according to Equation 1:

$$\omega_{MW} = \frac{\lambda_{in} + 2\lambda_{ex}}{\epsilon_{in} + 2\epsilon_{ex}} \quad \text{[Equation 1]}$$

wherein $\lambda_{in}$ is the conductivity inside the 3D structure, $\lambda_{ex}$ is the conductivity outside the 3D structure, $\varepsilon_{in}$ is the dielectric constant inside the 3D structure and $\varepsilon_{ex}$ is the dielectric constant outside the 3D structure.

* * * * *